US009797044B2

(12) United States Patent
Asano et al.

(10) Patent No.: US 9,797,044 B2
(45) Date of Patent: Oct. 24, 2017

(54) AQUEOUS ACIDIC COMPOSITION FOR FORMING CHROMIUM-CONTAINING CHEMICAL CONVERSION COATING ON IRON-BASED MEMBER, AND IRON-BASED MEMBER HAVING CHEMICAL CONVERSION COATING FORMED USING THE COMPOSITION

(71) Applicant: Yuken Industry Co., Ltd, Aichi (JP)

(72) Inventors: Mari Asano, Aichi (JP); Yuu Endo, Aichi (JP)

(73) Assignee: Yuken Industry Co., Ltd., Aichi (JP)

( * ) Notice: Subject to any disclaimer, the term of this patent is extended or adjusted under 35 U.S.C. 154(b) by 211 days.

(21) Appl. No.: 14/156,013

(22) Filed: Jan. 15, 2014

(65) Prior Publication Data

US 2014/0130941 A1 May 15, 2014

Related U.S. Application Data

(63) Continuation of application No. PCT/JP2012/067958, filed on Jul. 13, 2012.

(30) Foreign Application Priority Data

Jul. 15, 2011 (JP) ..... 2011-156279

(51) Int. Cl.

| | |
|---|---|
| ***C23C 22/30*** | (2006.01) |
| ***C23C 22/05*** | (2006.01) |
| ***C23C 22/50*** | (2006.01) |
| ***C23C 22/46*** | (2006.01) |
| *C23C 22/00* | (2006.01) |

(52) U.S. Cl.
CPC ..... *C23C 22/05* (2013.01); *C23C 22/46* (2013.01); *C23C 22/50* (2013.01); *C23C 2222/10* (2013.01); *C23C 2222/20* (2013.01)

(58) Field of Classification Search
CPC ..... C23C 2222/10; C23C 22/30
USPC ..... 148/267
See application file for complete search history.

(56) References Cited

FOREIGN PATENT DOCUMENTS

| | | | | |
|---|---|---|---|---|
| JP | 2005-126797 A | | 5/2005 | |
| JP | 2007-321234 A | | 12/2007 | |
| JP | 2008-019512 A | | 1/2008 | |
| JP | 2008-530360 A | | 8/2008 | |
| JP | 2009-173978 | * | 8/2009 | ..... C23C 22/53 |
| WO | 2006/088518 A2 | | 8/2006 | |

OTHER PUBLICATIONS

Notification of Reason(s) for Refusal in corresponding Japanese application No. JP2012-536117 dated Sep. 17, 2013 (4 pages).
International Search Report for PCT/JP2012/067958 dated Oct. 16, 2012 (3 pages).
Written Opinion by International Search Authority for PCT/JP2012/067958 dated Oct. 16, 2012 (4 pages).
Office Action in counterpart Chinese Patent Application No. 201280035056.X dated Nov. 15, 2016 (21 pages).

* cited by examiner

*Primary Examiner* — Lois Zheng
(74) *Attorney, Agent, or Firm* — Osha Liang LLP

(57) ABSTRACT

An aqueous acidic composition is provided for forming a chromium-containing chemical conversion coating on a member having an iron-based metal surface. The composition contains a water-soluble trivalent chromium-containing substance, a water-soluble zinc-containing substance, and a water-soluble polyvalent carboxylic acid compound. On the total composition basis, the water-soluble trivalent chromium-containing substance has a content of 60 mmol/L or more in terms of chromium, the water-soluble zinc-containing substance has a molar content in terms of zinc such that a ratio of the content is 0.6 or more to a molar content in terms of chromium of the water-soluble trivalent chromium-containing substance, and the water-soluble polyvalent carboxylic acid compound has a content of 55 mmol/L or more in terms of polyvalent carboxylic acid. The composition is free from allylamine, polyallylamine, aromatic sulphonic acid, aromatic sulphonic acid-formaldehyde condensate, and derivatives thereof, and fluorine-based substance, hexavalent chromium-containing substance, and film-forming organic component.

13 Claims, No Drawings

AQUEOUS ACIDIC COMPOSITION FOR FORMING CHROMIUM-CONTAINING CHEMICAL CONVERSION COATING ON IRON-BASED MEMBER, AND IRON-BASED MEMBER HAVING CHEMICAL CONVERSION COATING FORMED USING THE COMPOSITION

TECHNICAL FIELD

The present invention relates to a composition for chemical conversion treatment capable of forming a chemical conversion coating on an iron-based metal surface without using fluorine-based substance and hexavalent chromium that are harmful to natural environment and also without using organic components, such as film-forming organic component and allylamine, and further relates to a member having the chemical conversion coating formed using the treatment on an iron-based metal surface.

An aqueous acidic composition as used herein refers to a liquid composition that contains water as the main solvent and has acidic liquid property, i.e., a pH of less than 7. A solid substance may be dispersed and/or precipitated therein.

A member having an iron-based metal surface as used herein refers to a member having, as at least a part of its surface, an iron-based metal surface that is a surface comprising an iron-based metal material that contains iron or iron alloy as the main component. A member having such an iron-based metal surface is also referred to as an "iron-based member" herein. The iron-based member may have, as at least a part of its surface, a surface comprising a zinc-based metal material.

A member having a zinc-based metal surface as used herein refers to a member having, as at least a part of its surface, a zinc-based metal surface that is a surface comprising a zinc-based metal material that contains zinc or zinc alloy as the main component.

BACKGROUND ART

In recent years, according to directives for environmental protection, such as RoHS (Restriction of the Use of Certain Hazardous Substances in Electrical and Electronic Equipment) directive and ELV (End of Life Vehicles) directive, it has been required to regulate the use of harmful substances (such as lead, mercury, cadmium, and hexavalent chromium).

To this end, chromate coatings, which are effective as chemical conversion coatings for anticorrosion of members having metal surfaces, such as zinc-plated members, have been formed through the use of a chemical conversion treatment liquid that contains trivalent chromium rather than the use of a composition for chemical conversion treatment using a chromate salt that contains hexavalent chromium (a composition for chemical conversion treatment is also referred to as "chemical conversion treatment liquid" here and hereinafter). The chemical conversion coating obtained using a conventional hexavalent chromium-containing chemical conversion treatment liquid contains soluble hexavalent chromium in the coating. Therefore, such a coating is a target of regulations according to the above directives.

Chromate using a trivalent chromium-containing chemical conversion treatment liquid has become general in such a way, but the trivalent chromium-containing chemical conversion coating obtained through the use of the trivalent chromium-containing chemical conversion treatment liquid is to be formed substantially on a zinc-based metal surface, and cannot used for an iron-based member (a member having an iron-based metal surface). That is, if the trivalent chromium-containing chemical conversion treatment liquid is caused to contact with an iron-based member, then the iron-based material at the surface of the member is rapidly corroded to generate red rust on the iron-based member.

This problem is particularly serious if the member having a zinc-based metal surface is configured such that the base material is provided as an iron-based member having a complex shape (typical examples thereof include secondary products, such as brake caliper and screw.) and plating of a zinc-based metal material (referred also to as "zinc-based plating") is performed on the surface thereof. The thickness of the zinc-based plating formed on the base material may considerably vary due to complexity of the shape. If, in this case, the trivalent chromium-containing chemical conversion treatment liquid is caused to contact with that member, then a part having a particularly thin thickness of the zinc-based plating will be subjected to an insufficient reaction that the chemical conversion treatment liquid less dissolves the zinc-based material at the surface for dissolution of zinc. This may lead to insufficient deposition, which is considered as a counterpart reaction of the dissolution of zinc, of a substance (such as oxide of chromium) that forms the chemical conversion coating, and may consequently progress a reaction that the iron-based metal surface of the base material is eaten by the chemical conversion treatment liquid. In such a case, the chemical conversion coating may be formed on a part of the member, but the part having a thin thickness of the zinc-based plating will be suffered from the occurrence of red rust. Such a member will be a defective product, which may deteriorate the productivity of products.

Patent Literature 1 discloses, as a technique of forming a chemical conversion coating on an iron-based member, a process for preparing zirconium-chromium chemical conversion coatings on iron and iron alloys to improve the corrosion resistance and adhesive bonding strength, the process comprising treating iron and iron alloys with an acidic aqueous solution having a pH ranging from about 2.5 to 5.5, the acidic aqueous solution comprising, per liter of solution, from about 0.01 to 22 grams of a trivalent chromium compound, about 0.01 to 12 grams of a hexafluorozirconate, about 0.0 to 12 grams of at least one fluorocompound selected from the group consisting of tetrafluoroborate, hexafluorosilicate and mixtures thereof, from about 0.0 to 10 grams of at least one divalent zinc compound, from 0.0 to about 10 grams of at least one water-soluble thickener and from 0.0 to about 10 grams of at least one water-soluble surfactant.

Patent Literature 2 discloses a trivalent chromium chemical conversion coating treatment agent which is aqueous solution for forming a trivalent chromium chemical conversion coating on a metal surface and which contains: 1) a trivalent chromium compound and a cobalt compound; 2) at least one ion supply source selected from chlorine ion, nitrate ion and sulphate ion; and 3) organic acid or organic acid salt, and further contains: 4) at least one selected from allylamine, polyallylamine, aromatic sulfonic acid, aromatic sulfonic acid-formaldehyde condensate, and a derivative thereof. According to the literature, it is said that containing components such as allylamine allows a trivalent chrome chemical conversion coating to be formed even in a case where the pH is 2.5 or more and the etching to the metal base material surface is very weak.

PRIOR ART LITERATURE

Patent Literature

Patent Literature 1: JP2008-530360A
Patent Literature 2: JP2007-321234A

DISCLOSURE OF THE INVENTION

Problems to be Solved by the Invention

However, the acidic aqueous solution for forming a chemical conversion coating as disclosed in Patent Literature 1 may have to contain a fluorine-based substance which imposes a large burden on the environment. In addition, thickener and surfactant may have to be used, so that the use of this chemical conversion treatment liquid will increase the load in wastewater treatment, thus causing the raise in production cost. Patent Literature 2, on the other hand, merely discloses that an additional etchant (etching component) such as allylamine is present thereby to allow a chemical conversion coating to be formed even under a condition where a chemical conversion treatment liquid is used which has a low acidity of a pH of 2.5 or more (a pH of 3.0 or more in the case of an iron-based member according to an example of Patent Literature 2) so as to be unlikely to corrode the iron-based member, but nothing therein discloses whether a chemical conversion coating can appropriately be formed on the iron-based metal surface under a pH of less than 2.5 as in a commonly-used chemical conversion treatment liquid without corroding the iron-based member. In addition, components such as allylamine disclosed in Patent Literature 2 are likely to decompose or polymerize in the chemical conversion treatment liquid as acidic aqueous liquid, and the concentrations of these components may thus be difficult to be managed. Hence, according to the chemical conversion treatment liquid as disclosed in Patent Literature 2, it may be difficult to stably form a chemical conversion coating having excellent properties on an iron-based member.

In view of such circumstances, problems to be solved by the present invention include providing a novel trivalent chromium-containing composition (chemical conversion treatment liquid) that can be used even for an iron-based member and providing a production method for a member that has a chromium-containing chemical conversion coating on an iron-based metal surface.

Means for Solving the Problems

To solve the above problems, one aspect of the present invention provides an aqueous acidic composition (chemical conversion treatment liquid) for forming a chromium-containing chemical conversion coating on a member having an iron-based metal surface. The composition contains a water-soluble trivalent chromium-containing substance, a water-soluble zinc-containing substance, and a water-soluble polyvalent carboxylic acid compound. On the total composition basis, the water-soluble trivalent chromium-containing substance has a content of 60 mmol/L or more in terms of chromium, the water-soluble zinc-containing substance has a molar content in terms of zinc such that a ratio of the content is 0.6 or more to a molar content in terms of chromium of the water-soluble trivalent chromium-containing substance, and the water-soluble polyvalent carboxylic acid compound has a content of 55 mmol/L or more in terms of polyvalent carboxylic acid. The composition is free from allylamine, polyallylamine, aromatic sulphonic acid, aromatic sulphonic acid-formaldehyde condensate, and derivatives thereof, and fluorine-based substance, hexavalent chromium-containing substance, and film-forming organic component.

The above aqueous acidic composition may further have at least one of features below:

(1) the pH is less than 2.5, and preferably 0.5 or more and less than 2.5;

(2) the aqueous acidic composition further contains at least one water-soluble metal-containing substance that is a water-soluble substance that contains one or more metals selected from the group consisting of Co, Ni, Na, K, Ag, Fe, Ca, Mg, Zr, Sc, Ti, Mn, Cu, Sn, Mo, V, and W;

(3) the polyvalent carboxylic acid of the water-soluble polyvalent carboxylic acid compound comprises one or more polyvalent carboxylic acids selected from the group consisting of oxalic acid, malonic acid, and citric acid; and (4) the ratio of the molar content in terms of polyvalent carboxylic acid of the water-soluble polyvalent carboxylic acid compound is 0.5 or more, preferably 0.75 or more, and more preferably 1.0 or more, to the molar content in terms of chromium of the water-soluble trivalent chromium-containing substance on the total composition basis.

Another aspect of the present invention provides a production method of a member. The member comprises: a member to be treated having an iron-based metal surface; and a chromium-containing chemical conversion coating provided on at least a part of the iron-based metal surface of the member to be treated. The production method comprises: a first step that causes the above aqueous acidic composition according to the present invention to contact with the member to be treated; and a second step that washes the member to be treated having been contacted with the aqueous acidic composition to form a chromium-containing chemical conversion coating on the member to be treated.

In the above production method, the member to be treated to be supplied to the first step may further have a zinc-based metal surface, and the second step may form the chromium-containing chemical conversion coating further on at least a part of the zinc-based metal surface.

Still another aspect of the present invention provides a liquid composition for producing the above aqueous acidic composition according to the present invention. The liquid composition contains a water-soluble trivalent chromium-containing substance, a water-soluble zinc-containing substance, and a water-soluble polyvalent carboxylic acid compound. On the total composition basis, the water-soluble trivalent chromium-containing substance has a content of 300 mmol/L or more in terms of chromium, the water-soluble zinc-containing substance has a molar content in terms of zinc such that a ratio of the content is 0.6 or more to a molar content in terms of chromium of the water-soluble trivalent chromium-containing substance, and the water-soluble polyvalent carboxylic acid compound has a content of 275 mmol/L or more in terms of polyvalent carboxylic acid. The liquid composition is free from allylamine, polyallylamine, aromatic sulphonic acid, aromatic sulphonic acid-formaldehyde condensate, and derivatives thereof, and fluorine-based substance, hexavalent chromium-containing substance, and film-forming organic component.

The above liquid composition may further have at least one of features below:

(1) the liquid composition further contains at least one water-soluble metal-containing substance that is a water-soluble substance that contains one or more metals selected from the group consisting of Co, Ni, Na, K, Ag, Fe, Ca, Mg, Zr, Sc, Ti, Mn, Cu, Sn, Mo, V, and W; and (2) the ratio of the molar content in terms of polyvalent carboxylic acid of the water-soluble polyvalent carboxylic acid compound is 0.5 or more, preferably 0.75 or more, and more preferably 1.0 or more, to the molar content in terms of chromium of the water-soluble trivalent chromium-containing substance on the total composition basis.

Advantageous Effect of the Invention

According to the above invention, it can be achieved to form a chemical conversion coating having enhanced corrosion resistance on an iron-based member (a member having a chemical conversion coating on an iron-based metal surface) which would conventionally generate red rust at a stage of contacting with a chemical conversion treatment liquid or the subsequent washing stage, without using a fluorine-based material which imposes a large burden on the environment, without requiring a high cost material such as zirconium compound, and further without using improper components, such as film-forming organic component which increases the load in wastewater treatment and polyallylamine which causes instable quality of the chemical conversion coating.

BEST MODES FOR CARRYING OUT THE INVENTION

1. Composition for Chemical Conversion Treatment

The composition (chemical conversion treatment liquid) for chemical conversion treatment according to one embodiment of the present invention contains a water-soluble trivalent chromium-containing substance, a water-soluble zinc-containing substance, and a water-soluble polyvalent carboxylic acid compound. On the total composition basis, the content of the water-soluble trivalent chromium-containing substance is 60 mmol/L or more in terms of chromium, the molar content in terms of zinc of the water-soluble zinc-containing substance is an amount such that the ratio of the content is 0.6 or more to the molar content in terms of chromium of the water-soluble trivalent chromium-containing substance, and the content of the water-soluble polyvalent carboxylic acid compound is 55 mmol/L or more in terms of polyvalent carboxylic acid. The composition is free from allylamine, polyallylamine, aromatic sulphonic acid, aromatic sulphonic acid-formaldehyde condensate, and derivatives thereof, and fluorine-based substance, hexavalent chromium-containing substance, and film-forming organic component.

Being "free from allylamine, polyallylamine, aromatic sulphonic acid, aromatic sulphonic acid-formaldehyde condensate, and derivatives thereof" as used herein means that the above components, such as allylamine, which may have to be required in the chemical conversion treatment liquid according to the previously-described Patent Literature 2, are not added to the chemical conversion treatment liquid according to the present embodiment, and hence, these components are not substantially contained therein.

The fluorine-based substance as used herein refers to substances, such as fluorine ions, fluorometallic acid and ions thereof, which contain fluorine. Examples of fluorometallic acid include $H_2ZrF_6$, $H_2TiF_6$, $H_2HfF_6$, $H_2AlF_6$, $H_2SiF_6$, $H_2GeF_6$, $H_2SnF_6$, and $HBF_6$.

The film-forming organic component as used herein refers collectively to polymers, and monomers and oligomers as precursors of polymers. Examples of polymers as the film-forming organic components include water-soluble polymers, such as sodium polyacrylate, polyacrylamide, polyvinyl alcohol, polyethylenimine, polyethylene oxide and polyvinyl pyrrolidone, and water-dispersible polymers obtained by causing polymers, such as polyester-based, styrene-based and acrylic-based polymers, to be fine particles to have water dispersibility.

Treatment is performed such that the chemical conversion treatment liquid according to the present embodiment is caused to contact with an iron-based member thereby to form a chemical conversion coating on the iron-based member in priority to the occurrence of red rust. The treatment temperature may not be definitely determined because it depends on factors, such as the concentration and the pH. If the temperature is 20° C. or higher, the treatment may preferably be performed such that the contact time is 10 seconds or more, while if the temperature is 40° C. or higher, contact of 5-50 seconds may particularly be preferable. Contacting method may be, but not limited to, such that the iron-based member is immersed into the chemical conversion treatment liquid according to the present embodiment, or the chemical conversion treatment liquid is sprayed to the iron-based member.

The chemical conversion treatment liquid according to the present embodiment contains no film-forming organic component, and the chemical conversion treatment performed using this chemical conversion treatment liquid is therefore reaction-type chemical conversion treatment. More specifically, after a step (first step) has been completed which causes the iron-based member as a member to be treated having an iron-based metal surface and the chemical conversion treatment liquid to contact with each other, a step (second step) may be conducted which performs washing operation to remove the chemical conversion treatment liquid remaining on the surface of the iron-based member having been contacted with the chemical conversion treatment liquid using a fluid, typically water, thereby to form a chromium-containing chemical conversion coating on the iron-based member. After the second step of performing the washing operation, a step of drying the iron-based member may be conducted as necessary. If the drying is performed, conditions thereof may be freely set, and the iron-based member after washing may be left to be dried under an ordinary environment, or may also be actively heated. In addition, rust-preventive treatment may be performed for the iron-based member comprising the chemical conversion coating after the drying step, and/or treatment for causing the iron-based member comprising the chemical conversion coating to contact with a finishing agent may be performed between the second step of performing washing and the drying step.

The term as opposed to the above reaction-type chemical conversion treatment is application-type chemical conversion treatment, in which the above washing operation is not carried out, and the liquid layer comprising the chemical conversion treatment liquid remaining on the surface of the iron-based member is dried thereby to form a coated film layer, which is used as a chemical conversion coating.

Components of the chemical conversion treatment liquid according to the present embodiment will hereinafter be described in detail.

(1) Water-Soluble Trivalent Chromium-Containing Substance

The chemical conversion treatment liquid according to the present embodiment contains at least one type of a water-soluble trivalent chromium-containing substance. The water-soluble trivalent chromium-containing substance may be selected from the group consisting of trivalent chromium ($Cr^{3+}$) and a water-soluble substance that contains trivalent chromium. Examples of the water-soluble substance that contains trivalent chromium include $Cr[H_2O]_6^{3+}$.

It is preferred to use a water-soluble compound capable of generating the water-soluble trivalent chromium-containing substance in water (referred hereinafter to as "water-soluble trivalent chromium compound") as a substance to be compounded for containing the water-soluble trivalent chromium-containing substance in the chemical conversion treatment liquid, i.e., a raw material substance for the water-soluble trivalent chromium-containing substance.

Examples of the water-soluble trivalent chromium compound include trivalent chromium salt, such as chromium chloride, chromium sulfate, chromium nitrate, chromium phosphate and chromium acetate, and a compound obtained by reducing to trivalent using a reductant from hexavalent chromium contained in a hexavalent chromium compound, such as chromic acid and bichromate. The water-soluble trivalent chromium compound may consist only of one type of compound, or may comprise plural types. It should be appreciated that the chemical conversion treatment liquid according to the present embodiment contains substantially no hexavalent chromium because any hexavalent chromium compound is not added actively as a raw material to the chemical conversion treatment liquid according to the present embodiment.

The content of the water-soluble trivalent chromium compound in the chemical conversion treatment liquid according to the present embodiment is 60 mmol/L or more in terms of chromium with consideration for making it easy to form the chemical conversion coating. Unless otherwise stated, the content as used herein of a component of the chemical conversion treatment liquid means a content on the total chemical conversion treatment liquid basis. In view of stably performing the formation of the chemical conversion coating, it is preferred that the content of the water-soluble trivalent chromium compound is 70 mmol/L or more in terms of chromium. The upper limit of the content of the water-soluble trivalent chromium compound may preferably be, but not limited to, about 0.5 mol/L because unduly large content may possibly lead to problems, such as from the viewpoints of economic efficiency and waste liquid treatment. In view of stably suppressing the dissolving amount of hexavalent chromium, it may further be preferred that the upper limit is 0.25 mol/L or less.

(2) Water-Soluble Zinc-Containing Substance

The chemical conversion treatment liquid according to the present embodiment contains at least one type of a water-soluble zinc-containing substance. The water-soluble zinc-containing substance may be selected from the group consisting of zinc ions ($Zn^{2+}$) and a water-soluble substance that contains zinc ions. Examples of the water-soluble substance that contains zinc ions include $Zn[H_2O]_6^{2+}$.

It is preferred to use a water-soluble compound capable of generating the water-soluble zinc-containing substance in water (referred hereinafter to as "water-soluble zinc compound") as a substance to be compounded for containing the water-soluble zinc-containing substance in the chemical conversion treatment liquid, i.e., a raw material substance for the water-soluble zinc-containing substance.

Examples of the water-soluble zinc compound include compounds, such as zinc chloride, zinc carbonate, zinc oxide, zinc borate, zinc acetate, zinc sulfate, and zinc nitrate. The water-soluble zinc compound may consist only of one type of compound, or may comprise plural types.

The content of the water-soluble zinc-containing substance in the chemical conversion treatment liquid according to the present embodiment is, as a molar content in terms of zinc, from the viewpoint that a chemical conversion coating is readily formed, an amount such that the ratio of the content is 0.6 or more to the molar content in terms of chromium of the water-soluble trivalent chromium-containing substance (the ratio may also be referred to as "Zn/Cr ratio" herein). As previously described, in the chemical conversion treatment liquid according to the present embodiment, the lower limit of the molar content in terms of chromium of the water-soluble trivalent chromium-containing substance is 60 mmol/L, so that the lower limit of the content in terms of zinc of the water-soluble zinc-containing substance is 36 mmol/L or more.

The reason is not sure that the Zn/Cr ratio is set 0.6 or more in the chemical conversion treatment liquid according to the present embodiment thereby to allow the chemical conversion coating having enhanced corrosion resistance to be formed on the iron-based member. However, as will be described later in detail in Examples, if the Zn/Cr ratio is less than 0.6, then it may be difficult that the time before the occurrence of red rust is 1.0 hour or more when the neutral salt spray test is conducted in conformity with JIS Z2371: 2000 (ISO 9227: 1990). In view of stably obtaining a chemical conversion coating having more enhanced corrosion resistance, specifically corrosion resistance with such an extent that can ensure the time before the occurrence of red rust to be 1.5 hours or more for the above neutral salt spray test, it is preferred that the Zn/Cr ratio is 0.7 or more. In view of stably obtaining a chemical conversion coating having furthermore enhanced corrosion resistance, specifically corrosion resistance with such an extent that can ensure the time before the occurrence of red rust to be 2.0 hours or more for the above neutral salt spray test, it is preferred that the Zn/Cr ratio is 0.8 or more. It is particularly preferred that the Zn/Cr ratio is 1.0 or more because in this case a chemical conversion coating is stably obtained to have corrosion resistance with such an extent that can ensure the time before the occurrence of red rust to be 2.5 hours or more for the above neutral salt spray test.

The upper limit of the Zn/Cr ratio in the chemical conversion treatment liquid according to the present embodiment is not particularly limited. Cases where the Zn/Cr ratio is unduly large include cases that satisfy a condition where the molar content in terms of zinc of the water-soluble zinc-containing substance is unduly high and/or a condition where the molar content in terms of chromium of the water-soluble trivalent chromium-containing substance is unduly low, and the upper limit of the Zn/Cr ratio may therefore be set appropriately with consideration for disadvantages caused from respective cases.

In the chemical conversion treatment liquid according to the present embodiment, the upper limit of the content in terms of zinc of the water-soluble zinc-containing substance may preferably be, but not limited to, about 0.75 mol/L in terms of zinc because unduly large content of the water-soluble zinc-containing substance may possibly lead to problems, such as from the viewpoints of economic efficiency and waste liquid treatment. Moreover, due to the relationship with the contents of other components, the ability of suppressing white rust in the chemical conversion coating may deteriorate if the content of the water-soluble zinc-containing substance is unduly large. In view of stably achieving the suppression of white rust, the content in terms of zinc of the water-soluble zinc-containing substance may preferably be 0.5 mol/L or less, and more preferably 0.3 mol/L or less. As will be described later with reference to Examples, if the content of the water-soluble zinc-containing substance is unduly large, then the obtained chemical conversion coating may possibly have some change in its coating quality. Also in the case where the iron-based member has a zinc-based metal surface as a part of the surface of the member, from the viewpoint of easily forming the chemical conversion coating on the zinc-based metal surface, the content in terms of zinc of the water-soluble zinc-containing substance may preferably be an amount such that the Zn/Cr is 5 or less, more preferably 4 or less, and most preferably 3 or less.

(3) Water-Soluble Polyvalent Carboxylic Acid Compound

The chemical conversion treatment liquid according to the present embodiment contains a water-soluble polyvalent carboxylic acid compound. The "water-soluble polyvalent carboxylic acid compound" as used herein means a compound that comprises one or more polyvalent carboxylic acids selected from the group consisting of polyvalent carboxylic acid, which is a compound having plural carboxylic groups in a molecule, and ions, salts, derivatives and coordination compounds thereof, and is in a state of being dissolved in the chemical conversion treatment liquid as an aqueous composition.

Examples of polyvalent carboxylic acid of the water-soluble polyvalent carboxylic acid compound include: dicarboxylic acid, such as oxalic acid, malonic acid, succinic acid, glutaric acid, adipic acid, pimelic acid, suberic acid, azelaic acid, sebacic acid, maleic acid, phthalic acid and terephthalic acid; tricarboxylic acid, such as tricarballylic acid; hydroxy polyvalent carboxylic acid, such as glycolic acid, tartaric acid, citric acid and ascorbic acid; and amino group-containing polyvalent carboxylic acid, such as ethylenediaminetetraacetic acid (EDTA). The polyvalent carboxylic acid that constitutes the water-soluble polyvalent carboxylic acid compound may consist of one type of a compound, or may comprise plural types of compounds.

Among these polyvalent carboxylic acids, a polyvalent carboxylic acid having high hydrophilicity as the whole molecule may particularly be preferable. In consideration of the interaction with other components in the chemical conversion treatment liquid, a polyvalent carboxylic acid having an HLB value based on the Davies' method modified as below of 10 or more may be preferable. More specifically, according to the Davies' method, the number of groups is 2.1 for carboxylic acid group, the number of groups is 1.9 for hydroxyl group, and the number of groups is −0.475 for carbon that constitutes alkyl group, in which case a polyvalent carboxylic acid may be preferred that has a modified HLB value of 10 or more calculated by multiplying the number of groups by 0.5 for hydroxyl group and multiplying the number of groups by 3 for carbon that constitutes alkyl group. As the modified HLB value increases, the water-soluble polyvalent carboxylic acid compound becomes easy to dissolve in a solvent that contains water as the main component in the chemical conversion treatment liquid, and the possibility of destabilizing the liquid properties may be low. Among polyvalent carboxylic acids having a modified HLB value of 10 or more, oxalic acid, malonic acid and citric acid may particularly be preferable.

It is preferred to use a water-soluble compound capable of generating the water-soluble polyvalent carboxylic acid compound in water (referred hereinafter to as "water-soluble polyvalent carboxylic acid source") as a substance to be compounded for containing the water-soluble polyvalent carboxylic acid compound in the chemical conversion treatment liquid, i.e., a raw material substance for the water-soluble polyvalent carboxylic acid compound. Specific examples of the water-soluble polyvalent carboxylic acid source include: polyvalent carboxylic acid derivatives, such as polyvalent carboxylic ester; polyvalent carboxylic acid; and polyvalent carboxylic salt. In view of high solubility and easy interaction between the generated water-soluble polyvalent carboxylic acid compound and other components contained in the chemical conversion treatment liquid, it is preferred that the water-soluble polyvalent carboxylic acid source is polyvalent carboxylic salt. Examples of such polyvalent carboxylic salt include sodium oxalate, sodium malonate, sodium citrate, potassium oxalate, potassium malonate, and potassium citrate.

The content of the water-soluble polyvalent carboxylic acid compound in the chemical conversion treatment liquid according to the present embodiment is 55 mmol/L or more as a molar content in terms of polyvalent carboxylic acid. If the content of the water-soluble polyvalent carboxylic acid compound is unduly low, then advantages provided by containing the water-soluble polyvalent carboxylic acid compound cannot be obtained, so that a chemical conversion coating suitable for an iron-based member may be difficult to be formed thereon. In view of stably obtaining a chemical conversion coating having enhanced properties, the content of the water-soluble polyvalent carboxylic acid compound may be further preferably 80 mmol/L or more, and most preferably 100 mmol/L or more. In addition, from the viewpoint of appropriately causing interactions with other components contained in the chemical conversion treatment liquid according to the present embodiment, the ratio of the molar content in terms of polyvalent carboxylic acid of the water-soluble polyvalent carboxylic acid compound to the molar content in terms of chromium of the previously-described water-soluble trivalent chromium-containing substance may preferably be 0.5 or more, more preferably 0.6 or more, further preferably 0.75 or more, and most preferably 1.0 or more.

The upper limit of the content of the water-soluble polyvalent carboxylic acid compound in the chemical conversion treatment liquid according to the present embodiment is not particularly limited. The upper limit may appropriately be set considering that an unduly high content will increase the possibility of causing troubles such as that the liquid stability deteriorates, by-products are likely to be generated, and poor appearance occurs. When the polyvalent carboxylic acid of the water-soluble polyvalent carboxylic acid compound is malonic acid, the content in terms of polyvalent carboxylic acid of the water-soluble polyvalent carboxylic acid compound in the chemical conversion treatment liquid may range from 6 g/L to 30 g/L, as one example.

(4) Water-Soluble Cobalt-Containing Substance

The chemical conversion treatment liquid according to the present embodiment may contain a water-soluble cobalt-containing substance. The water-soluble cobalt-containing substance may be selected from the group consisting of cobalt ions ($Co^{2+}$) and a water-soluble substance that contains cobalt ions. Examples of the water-soluble cobalt-containing substance include $Co[H_2O]_6^{2+}$ and coordination compound of cobalt ions and carboxylic acid compound.

It is preferred to use a water-soluble compound capable of generating the water-soluble cobalt-containing substance in water (referred hereinafter to as "water-soluble cobalt compound") as a substance to be compounded for containing the water-soluble cobalt-containing substance in the chemical conversion treatment liquid, i.e., a raw material substance for the water-soluble cobalt-containing substance.

Examples of the water-soluble cobalt compound include cobalt chloride, cobalt sulfate, cobalt nitrate, cobalt phosphate, and cobalt acetate. The water-soluble cobalt compound may consist only of one type of compound, or may comprise plural types.

In the case where the water-soluble cobalt-containing substance is contained in the chemical conversion treatment liquid according to the present embodiment, the content thereof may preferably be 2 mmol/L or more and 30 mmol/L or less in terms of cobalt. If the content of the water-soluble cobalt-containing substance is less than 2 mmol/L in terms of cobalt, then it may be difficult to stably obtain advantages provided by containing the water-soluble cobalt-containing substance. On the other hand, unduly high content results in cost rise, and it is thus preferred that the content of the water-soluble cobalt-containing substance is 30 mmol/L or less in terms of cobalt. In the case where the iron-based member also has a zinc-based metal surface, it is preferred that the chemical conversion treatment liquid according to the present embodiment contains the water-soluble cobalt-containing substance and the content thereof is 8 mmol/L or more in terms of cobalt.

(5) Other Components

The chemical conversion treatment liquid according to the present embodiment may contain, in addition to the above substances, one or more components selected from the group consisting of metal ions, inorganic acid and anion thereof, inorganic colloid, silane coupling agent, and organic phosphorous compound. The chemical conversion treatment liquid may further contain one or more components selected from the group consisting of: polyphenol, such as pyrogallol and benzenediol; corrosion inhibitor; surfactant, such as dial, triol and amine; plastic dispersant; coloring material, such as dye, pigment, metal pigment generating agent and other pigment generating agents; desiccant; and dispersant.

It should be appreciated that the chemical conversion treatment liquid according to the present embodiment does not substantially contain any fluorine-based substance which imposes a large burden on the environment. Moreover, the chemical conversion treatment using the chemical conversion treatment liquid according to the present embodiment is reactive-type, so that substantially no film-forming organic component is contained therein. Furthermore, allylamine, polyallylamine, aromatic sulphonic acid, aromatic sulphonic acid-formaldehyde condensate, and derivatives thereof, which may have to be required in the chemical conversion treatment liquid according to the previously-described Patent Literature 2, are not required to be added. The chemical conversion treatment liquid according to the present embodiment can form a chemical conversion coating on an iron-based member without containing such components.

Examples of metal ions include ions of Ni, Na, K, Ag, Fe, Ca, Mg, Sc, Ti, Mn, Cu, Zn, Sn, Mo, V, and W, which may be present in a form of oxygen acid ions, such as tungstate ions, or in a form of coordination compound.

Examples of inorganic acid include hydrohalic acid, such as hydrochloric acid and hydrobromic acid other than hydrofluoric acid, chloric acid, perchloric acid, chlorous acid, hypochlorous acid, sulfuric acid, sulfurous acid, nitric acid, nitrous acid, phosphoric acid (orthophosphoric acid), polyphosphoric acid, metaphosphoric acid, pyrophosphoric acid, ultraphosphoric acid, hypophosphorous acid, and superphosphoric acid. It is preferred that, among the above, one or more inorganic acids selected from the group consisting of hydrohalic acid other than hydrofluoric acid, sulfuric acid, nitric acid, and phosphoric acid (orthophosphoric acid) are contained as anions.

The concentration of these inorganic acids and/or inorganic acid ions in the chemical conversion treatment liquid is not particularly limited. The ratio of the total molar concentration of inorganic acids and inorganic acid ions to the total molar concentration of trivalent chromium and the above metal ions may ordinarily be 0.1 or more and 10 or less, and preferably 0.5 or more and 3 or less.

Examples of inorganic colloid include silica sol, alumina sol, titanium sol and zirconia sol, and examples of silane coupling agent include vinyltriethoxysilane and γ-methacryloxypropyltrimethoxysilane.

(6) Solvent and pH

The solvent of the chemical conversion treatment liquid according to the present embodiment contains water as the main component. As solvent except water, an organic solvent, such as alcohol, ether and ketone, which has a high solubility in water, may be mixed with water. In this case, the ratio thereof may preferably be 10 vol % or less to the whole solvent in view of the stability in the whole chemical conversion treatment liquid.

In view of progressing the chemical conversion treatment, the chemical conversion treatment liquid according to the present embodiment is caused to be acidic, and the pH is therefore less than 7. If a chemical conversion treatment liquid having a high acidity, i.e., a low pH of 3.0 or less, is caused to contact with an iron-based member, then corrosion may often progress dominantly on the iron-based metal surface rather than the formation of a chemical conversion coating, but the chemical conversion treatment liquid according to the present embodiment can progress the formation of a chemical conversion coating in priority to corrosion even under such a low pH. This feature is particularly significant if the pH of the chemical conversion treatment liquid according to the present embodiment is less than 2.5. The lower limit of the pH of the chemical conversion treatment liquid according to the present embodiment may preferably be, but not limited to, 0.5 or more, more preferably 1.0 or more, further preferably 1.6 or more, and most preferably 1.8 or more, in view of obtaining enhanced properties of the chemical conversion coating, in particular appearance thereof.

2. Concentrated Composition for Preparing Chemical Conversion Treatment Liquid

Preparing a liquid composition having a formulation in which main components of the above chemical conversion treatment liquid are concentrated about 5 to 20 times (referred hereinafter to as "concentrated liquid for chemical conversion treatment") may save an effort to prepare the content of each component individually, may make it easy to storage thereof, and is thus preferable. When this concentrated liquid for chemical conversion treatment is prepared, upper limits may be provided for the contents of the above respective components with consideration for the solubility of each component.

More specifically, if a composition is prepared in which, on the total composition basis, the content of the water-soluble trivalent chromium-containing substance is 300 mmol/L or more in terms of chromium, the molar content in terms of zinc of the water-soluble zinc-containing substance is an amount such that the ratio of the content is 0.6 or more to the molar content in terms of chromium of the water-soluble trivalent chromium-containing substance, and the content of the water-soluble polyvalent carboxylic acid compound is 275 mmol/L or more in terms of polyvalent carboxylic acid, and the composition is free from allylamine, polyallylamine, aromatic sulphonic acid, aromatic sulphonic acid-formaldehyde condensate, and derivatives thereof, and fluorine-based substance, hexavalent chromium-containing substance, and film-forming organic component, then it can be achieved to readily obtain the above chemical conversion treatment liquid according to the present embodiment through a preparation step that include a step of diluting the composition with an appropriate dilution ratio from 5 to 20 using a certain solvent, such as water in usual.

3. Member to be Subjected to Chemical Conversion Treatment

The chemical conversion treatment liquid according to the present embodiment is for the purpose of forming a chemical conversion coating that contains trivalent chromium on an iron-based member, and hence, a member to be the treatment target is an iron-based member that has an iron-based metal surface. Typical example of such a member is steel material.

The iron-based member may comprise a zinc-based metal surface because the chemical conversion treatment liquid according to the present embodiment can form a trivalent chromium-containing chemical conversion coating that has enhanced corrosion resistance even to the zinc-based metal surface. Examples of such a member include an iron-based member (which may be a steel material as a specific example) that has a part which has not been subjected to zinc-based plating such as by masking the part, and an iron-based member that has been subjected to zinc-based plating for the surface, but has a part where the thickness of the zinc-based plating is locally small in particular (thin plating part) or has a part which has not been plated.

If such a member is contacted with a conventional chemical conversion treatment liquid for forming a trivalent chromium-containing chemical conversion coating, then the iron-based metal surface is exposed at the part not having been subjected to zinc-based plating or at the thin plating part, so that a trivalent chromium-containing chemical conversion coating may not appropriately be formed and red rust may possibly occur. In this regard, red rust will occur immediately (within 30 minutes) if the neutral salt spray test is carried out for the member having such a part. In contrast, using the chemical conversion treatment liquid according to the present embodiment allows an appropriate chemical conversion coating to be formed even at the thin plating part, and it can be achieved to obtain a member in which red rust does not readily occur.

The composition of the above zinc-based plating may be pure zinc or may also be zinc alloy. In the case of zinc alloy plating, examples of metal to be alloyed include iron, nickel, and aluminum. Method of plating may be electroplating or may also be hot-dip plating. In the case of electroplating, any of cyanide bath, chloride bath, sulfuric acid bath and zincate bath may be used. In the case of hot-dip plating, alloying process may be performed after the plating.

EXAMPLES

Advantageous effects of the present invention will hereinafter be described with reference to Examples, but the present invention is not limited thereto.

Example 1

(1) Preparation of Test Members (Test 1-1)

Chemical conversion treatment liquid 1-1 was prepared to have a pH of 2.0 and contain a water-soluble trivalent chromium-containing substance with a content in terms of chromium of 76 mmol/L using chromium nitrate, a water-soluble cobalt-containing substance with a content in terms of cobalt of 16 mmol/L using cobalt (II) nitrate hexahydrate, and, as a water-soluble polyvalent carboxylic acid compound, a water-soluble oxalic acid compound with a content in terms of oxalic acid of 110 mmol/L and a water-soluble malonic acid compound with a content in terms of malonic acid of 8 mmol/L.

Subsequently, a steel plate (SPCC, 5 cm×5 cm×t1 mm, surface area of 50 $cm^2$) was degreased and washed in water according to an ordinary method, and the surface thereof was then activated by performing nitric acid immersion (67.5%-nitric acid 3 ml/L, ordinary liquid temperature (25° C.), immersion time of 10 seconds). This activated steel plate was further washed in water for 10 seconds under ordinary temperature, and a pre-treated steel plate was thus obtained. This pre-treated steel plate was immersed for 40 seconds in the above chemical conversion treatment liquid 1-1 being maintained at 30° C. and stirred (this treatment will hereinafter be referred to as "test chemical conversion treatment 1"). After being pulled up from the chemical conversion treatment liquid 1-1, the steel plate was subjected to water washing (ordinary temperature, 10 seconds) and drying under 80±10° C. for 10 minutes, and a test member 1-1 was thus obtained.

(Test 1-2)

Chemical conversion treatment liquid 1-2 was prepared to have a pH of 2.0 and contain a water-soluble trivalent chromium-containing substance with a content in terms of chromium of 76 mmol/L using chromium nitrate, a water-soluble cobalt-containing substance with a content in terms of cobalt of 16 mmol/L using cobalt (II) nitrate hexahydrate, a water-soluble zinc-containing substance with a content in terms of zinc of 15 mmol/L using zinc nitrate, and a water-soluble polyvalent carboxylic acid compound with a content in terms of carboxylic acid (malonic acid) of 114 mmol/L using malonic acid.

Subsequently, a steel plate (SPCC, 5 cm×5 cm×t1 mm, surface area of 50 $cm^2$) was degreased and washed in accordance with an ordinary method, and the surface thereof was then activated by performing nitric acid immersion (67.5%-nitric acid 3 ml/L, ordinary liquid temperature (25° C.), immersion time of 10 seconds). This activated steel plate was further washed under ordinary temperature for 10 seconds, and a pre-treated steel plate was thus obtained. This pre-treated steel plate was immersed for 30 seconds in the above chemical conversion treatment liquid 1-2 being maintained at 40° C. and stirred (this treatment will hereinafter be referred to as "test chemical conversion treatment 2"). After being pulled up from the chemical conversion treatment liquid 1-2, the steel plate was subjected to water washing (ordinary temperature, 10 seconds) and drying under 80±10° C. for 10 minutes, and a test member 1-2 was thus obtained.

(Tests 1-3 to 1-5)

Chemical conversion treatment liquids 1-3 to 1-5 were prepared in the same manner as the chemical conversion treatment liquid 1-2 except for changing the compounding amount of zinc nitrate hexahydrate, i.e., changing the contents in terms of zinc of the water-soluble zinc-containing substances to 31 mmol/L, 46 mmol/L, and 61 mmol/L, respectively. Each pH was 2.0.

These chemical conversion treatment liquids 1-3 to 1-5 were used to perform the same treatment as that in the test 1-2, and test members 1-3 to 1-5 were thus obtained, respectively.

(Test 1-6)

Chemical conversion treatment liquid 1-6 was prepared under the same conditions as those for the chemical conversion treatment liquid 1-1, i.e., the same contents of the water-soluble trivalent chromium-containing substance, the water-soluble cobalt-containing substance and the water-soluble polyvalent carboxylic acid compound and the same pH, except for further containing a water-soluble zinc-containing substance with a content in terms of zinc of 76 mmol/L using zinc nitrate hexahydrate.

The chemical conversion treatment liquid 1-6 was used to carry out the test chemical conversion treatment 1 for a pre-treated steel plate, then the obtained steel plate was subjected to water washing and cleansing under the same conditions as those for the Example 1, and a test member 1-6 was thus obtained.

(Test 1-7)

Chemical conversion treatment liquid 1-7 was prepared in the same manner as the chemical conversion treatment liquid 1-6 except for changing the content in terms of zinc of the water-soluble zinc-containing substance to 230 mmol/L. The same operations as those in the test 1-6 were performed using the chemical conversion treatment liquid 1-7, and a test member 1-7 was thus obtained.

(Test 1-8)

Chemical conversion treatment liquid 1-8 was prepared in the same manner as the chemical conversion treatment liquid 1-6 except for changing the content in terms of zinc of the water-soluble zinc-containing substance to 300 mmol/L. The same operations as those in the test 1-6 were performed using the chemical conversion treatment liquid 1-8, and a test member 1-8 was thus obtained.

(Tests 1-9 to 1-11)

A known chloride bath (METASU MZ-996 available from YUKEN INDUSTRY CO., LTD.) was used to prepare a large number of SPCC steel plates each formed thereon with an electroplated zinc coating of 10 μm (referred hereinafter to as "plated steel plates"). While a separately prepared chemical conversion treatment liquid 1-1 was maintained to have a pH of 2.0 and a liquid temperature of 30° C. and the zinc concentration in the liquid was appropriately measured, these plated steel plates were in turn immersed in the chemical conversion treatment liquid 1-1 each for 40 seconds. In such a way, a chemical conversion treatment liquid 1-9 was obtained from the chemical conversion treatment liquid 1-1 so as to contain a water-soluble zinc-containing substance with a content in terms of zinc of 76 mmol/L.

The zinc nitrate hexahydrate used in the chemical conversion treatment liquid 1-6 was substituted by zinc chloride, and a chemical conversion treatment liquid 1-10 was thus obtained to contain a water-soluble zinc-containing substance with a content in terms of zinc of 76 mmol/L and have a pH of 2.0.

The zinc nitrate hexahydrate used in the chemical conversion treatment liquid 1-6 was substituted by zinc sulfate heptahydrate, and a chemical conversion treatment liquid 1-11 was thus obtained to contain a water-soluble zinc-containing substance with a content in terms of zinc of 76 mmol/L and have a pH of 2.0.

The same operations as those in the test 1-6 were performed using the chemical conversion treatment liquids 1-9 to 1-11, and test members 1-9 to 1-11 were thus obtained.

(2) Evaluation Method (A) Appearance

Color tone of the surface of each test member after drying was observed visually and evaluated in accordance with the criteria below:

A (excellent): blue color to white silver color or interference color;

B (good): red-purple color;

C (acceptable): colorless or yellow color; and

D (defective): other colors (such as brown color).

(B) Time Before Occurrence of Red Rust (Salt Spray Test)

For the above test members 1-1 to 1-11, the neutral salt spray test was conducted in conformity with JIS Z2371: 2000 (ISO 9227: 1990), which was brought to a stop every 30 minutes to observe visually the surface of each test member, and the time when red rust was observed was to be the time before the occurrence of red rust.

(3) Evaluation Results

Evaluation results are listed in Table 1.

TABLE 1

| | Water-soluble zinc-containing substance | | Content in terms of chromium of water-soluble trivalent chromium containing-substance | | Water-soluble Polycarboxylic acid compound | | | | Time before occurrence of red rust |
|---|---|---|---|---|---|---|---|---|---|
| Test | Supply source | Content in terms of zinc (mmol/L) | (mmol/L) | Zn/Cr ratio | Oxalic acid (mmol/L) | Malonic acid (mmol/L) | Appearance Color | Appearance Evaluation | (hours) |
| 1-1 | | 0 | 76 | 0 | 110 | 8 | Blue color | A | 0.5 |
| 1-2 | Zinc nitrate | 15 | 76 | 0.2 | 114 | 0 | Yellow color | C | 0.5 |
| 1-3 | hexahydrate | 31 | 76 | 0.4 | 114 | 0 | Yellow color | C | 0.5 |
| 1-4 | | 46 | 76 | 0.6 | 114 | 0 | Yellow color | C | 1.0 |
| 1-5 | | 61 | 76 | 0.8 | 114 | 0 | Blue color | A | 2.0 |
| 1-6 | | 76 | 76 | 1.0 | 110 | 8 | Blue color | A | 2.5 |
| 1-7 | | 230 | 76 | 3.0 | 110 | 8 | Red-purple color | B | 3.5 |
| 1-8 | | 300 | 76 | 3.9 | 110 | 8 | Colorless | C | 4.0 |
| 1-9 | Plating dissolving liquid | 76 | 76 | 1.0 | 110 | 8 | Blue color | A | 2.5 |
| 1-10 | Zinc chloride | | | | | | Blue color | A | 1.5 |
| 1-11 | Zinc sulfate heptahydrate | | | | | | Blue color | A | 1.5 |

It has been confirmed that the water-soluble zinc-containing substance is contained so that the Zn/Cr ratio becomes 0.6 or more thereby to allow the time before the occurrence of red rust to be 1.0 hour or more, and any of water-soluble zinc compound and zinc plating dissolving liquid can be used as a supply source for the water-soluble zinc-containing substance.

For the test members 1-1, 1-6 and 1-8 each exhibiting different appearance and/or different time before the occurrence of red rust, surface analysis was performed using an XPS (AXIS-HIs available from SHIMADZU CORPORATION). Analysis conditions were as follows:

light source: Al with monochromator; and output: 10 mA, 15 kV.

As a result, differences were observed as shown in Table 2.

TABLE 2

| Test member | Cr | Fe | Zn |
|---|---|---|---|
| 1-1 | Detected | Detected | Not detected |
| 1-6 | Detected | Not detected | Detected |
| 1-8 | Detected | Detected | Detected |

In any of these cases, measurement of chemical shift has suggested that chromium exists as $Cr_2O_3$ and $CrO_3$, iron as $Fe_2O_3$, FeO, $Fe_3O_4$ and metal Fe, and zinc as ZnO. From this result, there is a possibility that the chemical conversion coating formed using the chemical conversion treatment liquid according to the present invention has a hybrid passivation film of Cr and Zn in contrast to the prior art where the chemical conversion coating formed using a conventional chemical conversion treatment liquid has a passivation film of Cr.

Example 2

(Tests 2-1 to 2-4)

Chemical conversion treatment liquids 2-1 to 2-4 were prepared in the same manner as the chemical conversion treatment liquid 1-6 except for changing each pH. Respective pH values of the chemical conversion treatment liquids are listed in Table 3. The same operations as those in the test 1-6 were performed using the chemical conversion treatment liquids 2-1 to 2-4, and test members 2-1 to 2-4 were thus obtained. The test members were subjected to the same evaluations as those in Example 1. Evaluation results are listed in Table 3.

(Tests 2-5 and 2-6)

Pre-treated steel plates were each subjected to chemical conversion treatment of 40 seconds immersion using the chemical conversion treatment liquid 1-6 of a temperature maintained as shown in Table 3, followed by water washing and drying in the same manner in Example 1, and test members 2-5 and 2-6 were thus obtained. The same evaluations as those in Example 1 were performed for the test members. Evaluation results are listed in Table 3.

TABLE 3

| Test | Zn/Cr ratio | pH | Treatment temperature (° C.) | Appearance Color | Appearance Evaluation | Salt spray test Time before occurrence of red rust (hours) |
|---|---|---|---|---|---|---|
| 2-1 | 1.0 | 1.6 | 30 | Red-purple color | B | 2.5 |
| 2-2 | | 1.8 | | Blue color | A | 2.5 |

TABLE 3-continued

| Test | Zn/Cr ratio | pH | Treatment temperature (° C.) | Appearance Color | Appearance Evaluation | Salt spray test Time before occurrence of red rust (hours) |
|---|---|---|---|---|---|---|
| 1-6 | | 2.0 | | Blue color | A | 2.5 |
| 2-3 | | 2.2 | | Blue color | A | 2.5 |
| 2-4 | | 2.4 | | Blue color | A | 2.5 |
| 1-6 | 1.0 | 2.0 | 30 | Blue color | A | 2.5 |
| 2-5 | | | 40 | Blue color | A | 2.5 |
| 2-6 | | | 50 | Red-purple color | B | 1.5 |

It has become apparent that variations in the pH and the treatment temperature cause some changes in finished appearance, but do not specifically affect the corrosion resistance. In particular, it has been confirmed that the chemical conversion treatment liquid according to the present invention can rapidly form, even pH is 2.5 or less though, when contacted with an iron-based member, the chemical conversion coating in priority to corrosion of the iron-based member, and the formed chemical conversion coating has good appearance and enhanced corrosion resistance.

Example 3

(Tests 3-1 to 3-10)

Chemical conversion treatment liquids 3-1 to 3-7 were prepared in the same manner as the chemical conversion treatment liquid 1-6 except for individually varying the content of each component contained also in the chemical conversion treatment liquid 1-1. In addition, chemical conversion treatment liquids 3-8 to 3-10 were each prepared in the same manner as the chemical conversion treatment liquid 1-6 except for further containing colloidal silica (average particle diameter of 10 to 12 nm) to have each respective different content. The components and the contents thereof in the respective chemical conversion treatment liquids varied from those in the chemical conversion treatment liquid 1-6 are listed in Table 4 (including cases of not containing). The same operations as those in the test 1-6 were performed using the chemical conversion treatment liquids 3-1 to 3-10, and test members 3-1 to 3-10 were thus obtained. The test members were subjected to the same evaluations as those in Example 1. Evaluation results are listed in Table 4.

TABLE 4

| Test | Content-varied component Type | Content (mmol/L) | Zn/Cr ratio | Appearance Color | Appearance Evaluation | Salt spray test Time before occurrence of red rust (hours) |
|---|---|---|---|---|---|---|
| 1-6 | Water-soluble trivalent chromium-containing substance | 76 | 1.0 | Blue color | A | 2.5 |
| 3-1 | | 96 | 0.8 | Blue color | A | 2.5 |
| 1-6 | Oxalic acid | 110 | 1.0 | Blue color | A | 2.5 |
| 3-2 | | 165 | | Blue-white color | A | 1.5 |

TABLE 4-continued

| Test | Content-varied component Type | Content (mmol/L) | Zn/Cr ratio | Appearance Color | Evaluation | Salt spray test Time before occurrence of red rust (hours) |
|---|---|---|---|---|---|---|
| 3-3 | Water-soluble cobalt-containing substance | 0 | | Blue-white color | A | 2.5 |
| 3-4 | | 5.1 | | Blue-white color | A | 3.5 |
| 3-5 | | 10 | | Blue-white color | A | 3.5 |
| 1-6 | | 16 | | Blue color | A | 2.5 |
| 3-6 | | 21 | | Blue-white color | A | 2.5 |
| 3-7 | | 26 | | Blue-white color | A | 2.5 |
| 1-6 | Colloidal silica | 0 | | Blue color | A | 2.5 |
| 3-8 | | 4.1 | | Blue-white color | A | 3.5 |
| 3-9 | | 8.3 | | Blue-white color | A | 2.5 |
| 3-10 | | 16.6 | | Blue-white color | A | 1.5 |

It has been confirmed that the time before the occurrence of red rust based on the neutral salt spray test varies little if the content of each component is varied within the range in the above Examples. It also has been confirmed that the colloidal silica-containing chemical conversion treatment liquids can form excellent chemical conversion coatings on iron-based members.

Example 4

(Tests 4-1 to 4-4)

Steel plates (SPCC, 5 cm×5 cm×t1 mm, surface area of 50 $cm^2$) finished with known zinc electroplating (current density: 1.0 $A/dm^2$, plating thickness: 10 μm) were degreased and washed in water according to an ordinary method, and the surfaces thereof were then activated by performing nitric acid immersion (67.5%-nitric acid 3 ml/L, ordinary liquid temperature, immersion time of 10 seconds). These activated steel plates were further washed in water for 10 seconds at ordinary temperature, and pre-treated steel plates were thus obtained.

For the pre-treated steel plates obtained in such a manner, chemical conversion treatment liquids listed in Table 5 were used to perform the test chemical conversion treatment 1, then water washing and drying were carried out in the same manner in Example 1, and test members 4-1 to 4-4 were thus obtained. These test members were subjected to evaluation of appearance in Example 1 and further to evaluation of the time before the occurrence of white rust as will be described below.

(C) Time Before Occurrence of White Rust

For the above test members 4-1 to 4-4, the neutral salt spray test was conducted for a maximum of 120 hours in conformity with JIS Z2371, which was brought to a stop every 24 hours to observe visually the surface of each test member, and the time when white rust was observed was to be the time before the occurrence of white rust.

Evaluation results are listed in Table 5. Note that ">120" in columns of the evaluation results indicates that no white rust was observed even after 120 hours from the start of the test.

TABLE 5

| Test | Chemical conversion treatment liquid | Content in terms of zinc of water-soluble zinc-containing substance (mmol/L) | Zn/Cr ratio | Appearance Color | Evaluation | Time before occurrence of white rust (hours) |
|---|---|---|---|---|---|---|
| 4-1 | 1-1 | 0 | 0 | Blue-white color | A | >120 |
| 4-2 | 1-6 | 76 | 1.0 | Blue-white color | A | >120 |
| 4-3 | 1-7 | 230 | 3.0 | Blue-white color | A | 120 |
| 4-4 | 1-8 | 300 | 3.9 | Blue-white color | A | 96 |

A tendency has been found that the time before the occurrence of white rust slightly decreases as the Zn/Cr ratio increases.

Example 5

(Tests 5-1 to 5-3)

Concentrated liquid was prepared to have the concentration of each component 10 times that in the chemical conversion treatment liquid 1-1. Chemical conversion treatment liquids 5-1 to 5-3 were prepared to contain the concentrated liquid with respective concentrations shown in Table 6 and further to each contain the water-soluble zinc-containing substance with a content of 76 mmol/L. The chemical conversion treatment liquids each had a pH of 2.0. The chemical conversion treatment liquid 5-2 had the same composition as that of the chemical conversion treatment liquid 1-6.

For pre-treated steel plates, the chemical conversion treatment liquids 5-1 to 5-3 were used to carry out the test chemical conversion treatment 1, followed by water washing and drying in the same manner in Example 1, and test members 5-1 to 5-3 were thus obtained.

These test members were subjected to the same evaluations as those in Example 1. Results thereof are listed in Table 6.

TABLE 6

| Test | Concentration of concentrated liquid used (ml/L) | Content in terms of zinc of water-soluble zinc-containing substance (mmol/L) | Zn/Cr ratio | Appearance Color | Evaluation | Time before occurrence of red rust (hours) |
|---|---|---|---|---|---|---|
| 5-1 | 50 | 76 | 2.0 | Yellow-white color | C | 2.5 |
| 5-2 | 100 | | 1.0 | Blue-white color | A | 2.5 |
| 5-3 | 150 | | 0.7 | Blue-white color | A | 1.5 |

It has been confirmed that the time before the occurrence of red rust increases to enhance the corrosion resistance as the Zn/Cr ratio in the chemical conversion treatment liquid increases.

Example 6

(Tests 6-1 to 6-3)

Chemical conversion treatment liquids 6-1 to 6-3 were prepared to contain the concentrated liquid as prepared in Example 5 and the water-soluble zinc-containing substance with respective concentrations shown in Table 6. The chemical conversion treatment liquids each had a pH of 2.0. The chemical conversion treatment liquid 6-2 had the same composition as that of the chemical conversion treatment liquid 1-6.

For pre-treated steel plates, the chemical conversion treatment liquids 6-1 to 6-3 were used to carry out the test chemical conversion treatment 1, followed by water washing and drying in the same manner in Example 1, and test members 6-1 to 6-3 were thus obtained.

These test members were subjected to the same evaluations as those in Example 1. Results thereof are listed in Table 7.

TABLE 7

| Test | Concentration of concentrated liquid used (ml/L) | Content in terms of zinc of water-soluble zinc-containing substance (mmol/L) | Zn/Cr ratio | Appearance Color | Appearance Evaluation | Time before occurrence of red rust (hours) |
|---|---|---|---|---|---|---|
| 6-1 | 50 | 68 | 1.0 | Yellow-white color | C | 1.5 |
| 6-2 | 100 | 76 | | Blue-white color | A | 2.5 |
| 6-3 | 150 | 115 | | Blue-white color | A | 4.5 |

From the comparison with the results of Example 5, it has been confirmed that the corrosion resistance is improved as the contents of the water-soluble zinc-containing substance and the water-soluble trivalent chromium-containing substance increase if the Zn/Cr is the same.

Example 7

(Tests 7-1 to 7-15)

Chemical conversion treatment liquids 7-1 to 7-15 were prepared in the same manner in the preparation of the chemical conversion treatment liquid 1-2 except for increasing the content of the water-soluble zinc-containing substance to 76 mmol/L and changing the type and the content of the water-soluble carboxylic acid compound (the term "water-soluble carboxylic acid compound" is used as substitute for the term "water-soluble polyvalent carboxylic acid compound" because Example 7 involves cases of carboxylic acid other than polyvalent carboxylic acid), the content of the water-soluble trivalent chromium-containing substance, and whether to contain the water-soluble cobalt-containing substance and, if containing, the content thereof, as shown in Table 8.

The same operations (the test chemical conversion treatment 2, water washing and drying) as those in the test 1-2 were performed using the chemical conversion treatment liquids 7-1 to 7-15, and test members (iron material) 7-1 to 7-15 were thus obtained.

In addition, for pre-treated steel plates as members to be treated to be subjected to the test chemical conversion treatment 2, the chemical conversion treatment liquids 7-1 to 7-15 were used to carry out the same operations (the test chemical conversion treatment 2, water washing and drying) as those in the test 1-2, and test members (zinc material) 7-1 to 7-15 were thus obtained.

The same neutral salt spray test as performed for the test member 1-2 was carried out for each of the obtained test members (iron material) 7-1 to 7-15, and the time before the occurrence of red rust each in the respective test members (iron material) was measured.

In addition, the same neutral salt spray test as performed for the test member 4-1 was carried out for each of the test members (zinc material) 7-1 to 7-15, and the time before the occurrence of white rust each in the respective test members (zinc material) was measured.

Evaluation results are listed in Table 8.

TABLE 8

| Test | Content in terms of trivalent chromium of water-soluble trivalent chromium-containing substance (mmol/L) | Content in terms of zinc of water-soluble zinc-containing substance (mmol/L) | Content in terms of cobalt of water-soluble cobalt-containing substance (mmol/L) | Water-soluble carboxylic acid compound Type (carboxylic acid) | Water-soluble carboxylic acid compound Content in terms of carboxylic acid (mmol/L) | Zn/Cr ratio | Carboxylic acid/Cr ratio | Appearance Color | Appearance Evaluation | Salt spray test Time before occurrence of red rust (hours) | Salt spray test Time before occurrence of white rust (hours) |
|---|---|---|---|---|---|---|---|---|---|---|---|
| 7-1 | 76 | 76 | 16 | Oxalic acid | 114 | 1.0 | 1.5 | Blue color | A | 2.5 | >120 |
| 7-2 | | | | Malonic acid | 57 | | 0.75 | Blue-based interference color | A | 1.0 | >120 |
| 7-3 | | | | | 85 | | 1.1 | Blue-based interference color | A | 2.0 | >120 |
| 7-4 | | | | | 114 | | 1.5 | Blue-based interference color | A | 2.0 | >120 |
| 7-5 | | | | Oxalic acid<br>Malonic acid | 99<br>10 | | 1.4 | Blue color | A | 2.0 | >120 |
| 7-6 | | | | Tartaric acid | 114 | | 1.5 | Blue-white color | A | 3.0 | 24 |

TABLE 8-continued

| Test | Content in terms of trivalent chromium of water-soluble trivalent chromium-containing substance (mmol/L) | Content in terms of zinc of water-soluble zinc-containing substance (mmol/L) | Content in terms of cobalt of water-soluble cobalt-containing substance (mmol/L) | Water-soluble carboxylic acid compound: Type (carboxylic acid) | Water-soluble carboxylic acid compound: Content in terms of carboxylic acid (mmol/L) | Zn/Cr ratio | Carboxylic acid/Cr ratio | Appearance: Color | Appearance: Evaluation | Salt spray test: Time before occurrence of red rust (hours) | Salt spray test: Time before occurrence of white rust (hours) |
|---|---|---|---|---|---|---|---|---|---|---|---|
| 7-7 | | | | Citric acid | 114 | | 1.5 | Blue-white color | A | 2.0 | >120 |
| 7-8 | | | | Formic acid | 114 | | 1.5 | Yellow color | C | 1.0 | >120 |
| 7-9 | | | | Acetic acid | 114 | | 1.5 | Light yellow color | C | 0.5 | 24 |
| 7-10 | | | | Lactic acid | 114 | | 1.5 | Light yellow color | C | 0.5 | >120 |
| 7-11 | 38 | | | Malonic acid | 114 | 2.0 | 3.0 | Colorless | C | 0.5 | >120 |
| 7-12 | 57 | | | | | 1.3 | 2.0 | Colorless | C | 0.5 | >120 |
| 7-13 | 76 | | 0 | Oxalic acid | 114 | 1.0 | 1.5 | Blue-based Interference color | A | 2.5 | 72 |
| 7-14 | 76 | | 8 | | | | | Interference color | A | 2.0 | >120 |
| 7-15 | 76 | | 24 | | | | | Interference color | A | 2.0 | >120 |

It has been confirmed that an excellent chemical conversion coating is not formed on the iron-based member if the carboxylic acid of the water-soluble carboxylic acid compound is monocarboxylic acid or hydroxy monocarboxylic acid. It has also been confirmed that an excellent chemical conversion coating is not formed on the iron-based member if the content of the water-soluble trivalent chromium-containing substance is unduly low. It has further been confirmed that an excellent chemical conversion coating is formed not only on the iron-based metal surface but also on the zinc-based metal surface if the water-soluble cobalt-containing substance is contained in the chemical conversion treatment liquid and the content thereof is 8 mmol/L or more.

The invention claimed is:

1. An aqueous acidic composition for forming a chromium-containing chemical conversion coating on a member having a steel material surface which has a part which is not plated by zinc or zinc alloy, wherein the composition comprises a water-soluble trivalent chromium-containing substance, a water-soluble zinc-containing substance, and a water-soluble polyvalent carboxylic acid compound, on a total composition basis, the water-soluble trivalent chromium-containing substance has a content of 60 mmol/L or more in terms of chromium, the water-soluble zinc-containing substance has a molar content in terms of zinc such that a ratio of the content is 0.6 or more to a molar content in terms of chromium of the water-soluble trivalent chromium-containing substance, and the water-soluble polyvalent carboxylic acid compound has a content of 55 mmol/L or more in terms of polyvalent carboxylic acid;

wherein the water-soluble polyvalent carboxylic acid compound comprises one or more polyvalent carboxylic acids selected from a group consisting of oxalic acid, malonic acid, and citric acid;

wherein a ratio of a molar content in terms of polyvalent carboxylic acid of the water-soluble polyvalent carboxylic acid compound is 0.5 or more and 1.5 or less to the molar content in terms of chromium of the water-soluble trivalent chromium-containing substance on the total composition basis; and the composition is free from allylamine, polyallylamine, aromatic sulphonic acid, aromatic sulphonic acid-formaldehyde condensate, and derivatives thereof, and fluorine-based substance, hexavalent chromium-containing substance, and film-forming organic component.

2. The aqueous acidic composition according to claim 1, having a pH of less than 2.5.

3. The aqueous acidic composition according to claim 1, further comprising at least one water-soluble metal-containing substance that is a water-soluble substance that comprises one or more metals selected from a group consisting of Co, Ni, Na, K, Ag, Fe, Ca, Mg, Zr, Sc, Ti, Mn, Cu, Sn, Mo, V, and W.

4. The aqueous acidic composition according to claim 1, wherein a ratio of a molar content in terms of polyvalent carboxylic acid of the water-soluble polyvalent carboxylic acid compound is 1.0 or more and 1.5 or less to the molar content in terms of chromium of the water-soluble trivalent chromium-containing substance on the total composition basis.

5. A liquid composition for producing the aqueous acidic composition according to claim 1, wherein the liquid composition comprises a water-soluble trivalent chromium-containing substance, a water-soluble zinc-containing substance, and a water-soluble polyvalent carboxylic acid compound, on a total composition basis, the water-soluble trivalent chromium-containing substance has a content of 300 mmol/L or more in terms of chromium, the water-soluble zinc-containing substance has a molar content in terms of zinc such that a ratio of the content is 0.6 or more to a molar content in terms of chromium of the water-soluble trivalent chromium-containing substance, and the water-soluble polyvalent carboxylic acid compound has a content of 275 mmol/L or more in terms of polyvalent carboxylic acid; and the liquid composition is free from allylamine, polyallylamine, aromatic sulphonic acid, aromatic sulphonic acid-formaldehyde condensate, and derivatives thereof, and fluorine-based substance, hexavalent chromium-containing substance, and film-forming organic component.

6. The liquid composition according to claim 5, further comprising at least one water-soluble metal-containing substance that is a water-soluble substance that comprises one or more metals selected from a group consisting of Co, Ni, Na, K, Ag, Fe, Ca, Mg, Zr, Sc, Ti, Mn, Cu, Sn, Mo, V, and W.

7. The liquid composition according to claim 5, wherein a ratio of a molar content in terms of polyvalent carboxylic acid of the water-soluble polyvalent carboxylic acid compound is 0.5 or more to the molar content in terms of chromium of the water-soluble trivalent chromium-containing substance on the total composition basis.

8. A liquid composition for producing the aqueous acidic composition according to claim 1, the liquid composition having a pH of less than 2.5;

wherein the polyvalent carboxylic acid of the water-soluble polyvalent carboxylic acid compound comprises one or more polyvalent carboxylic acids selected from a group consisting of oxalic acid, malonic acid, and citric acid; and wherein a ratio of a molar content in terms of polyvalent carboxylic acid of the water-soluble polyvalent carboxylic acid compound is 0.75 or more to the molar content in terms of chromium of the water-soluble trivalent chromium-containing substance on the total composition basis.

9. A liquid composition for producing the aqueous acidic composition according to claim 1, the liquid composition having a pH of 1.6or more and 2.5 or less;

wherein the polyvalent carboxylic acid of the water-soluble polyvalent carboxylic acid compound comprises one or more polyvalent carboxylic acids selected from a group consisting of oxalic acid, malonic acid, and citric acid; and wherein a ratio of a molar content in terms of polyvalent carboxylic acid of the water-soluble polyvalent carboxylic acid compound is 0.75 or more and 2.0 or less to the molar content in terms of chromium of the water-soluble trivalent chromium-containing substance on the total composition basis.

10. The aqueous acidic composition according to claim 1, wherein the molar ratio of zinc to chromium in the composition is no more than 3:1.

11. The aqueous acidic composition according to claim 1, wherein the upper limit of the content of the water-soluble zinc-containing substance is about 0.076 mol/L in terms of zinc.amendments to the drawings.

12. A production method of a member, the member comprising: a member to be treated having a steel material surface which has a part which is not plated by zinc or zinc alloy; and a chromium-containing chemical conversion coating provided on at least a part of the steel material surface which is not plated of the member to be treated, the production method comprising:

a first step that causes the aqueous acidic composition according to either one of claims 1 to 4 to contact with the member to be treated; and a second step that washes the member to be treated having been contacted with the aqueous acidic composition to form a chromium-containing chemical conversion coating on the member to be treated.

13. The production method according to claim 12, wherein the member to be treated to be supplied to the first step further has a zinc-based metal surface, and the second step forms the chromium-containing chemical conversion coating further on at least a part of the zinc-based metal surface.

* * * * *